United States Patent [19]

Roemer

[11] 4,057,916

[45] Nov. 15, 1977

[54] SNOWMOBILE TRAIL LEVELER

[76] Inventor: Benjamin C. Roemer, Manitowish Waters, Wis. 54545

[21] Appl. No.: 632,651

[22] Filed: Nov. 17, 1975

[51] Int. Cl.[2] ..... E01H 5/00

[52] U.S. Cl. ..... 37/43 R; 172/393; 172/407; 172/548

[58] Field of Search ..... 171/114–116; 37/41, 43 R, 12, 10; 172/31, 393, 407, 413, 395, 748, 463, 452, 540, 541, 543–545, 548

[56] References Cited

U.S. PATENT DOCUMENTS

| | | | |
|---|---|---|---|
| 698,566 | 4/1902 | Shirreffs | 37/10 |
| 1,021,929 | 4/1912 | Hovey | 172/145 X |
| 1,670,539 | 5/1928 | Hicks | 172/544 |
| 2,330,302 | 9/1943 | Morkoski | 172/395 |
| 2,705,447 | 4/1955 | Robbins | 172/393 X |
| 2,751,831 | 6/1956 | Null | 37/43 R |
| 3,176,781 | 4/1965 | Morris | 172/395 |
| 3,429,061 | 2/1969 | Haban | 37/43 R |
| 3,661,213 | 5/1972 | Taylor | 172/145 |
| 3,804,178 | 4/1974 | West | 172/784 |
| Re. 27,530 | 12/1972 | Mitchell | 172/452 X |

FOREIGN PATENT DOCUMENTS

| | | | |
|---|---|---|---|
| 192,516 | 3/1967 | U.S.S.R. | 172/393 |

*Primary Examiner*—E. H. Eickholt
*Attorney, Agent, or Firm*—Michael, Best & Friedrich

[57] ABSTRACT

A trail leveler for smoothing snowmobile trails including a multi-blade rotating member positioned transversely to the path of the leveler and rotating in the direction opposite to the direction of travel of the leveler; and the leveler including a yoke-shaped adjustment linkage for changing the vertical position of the rear skis (or cleat track) in respect to the housing of the leveler to thereby provide adjustment of the position of the rotating member in respect to the surface of the trail to be worked.

4 Claims, 4 Drawing Figures

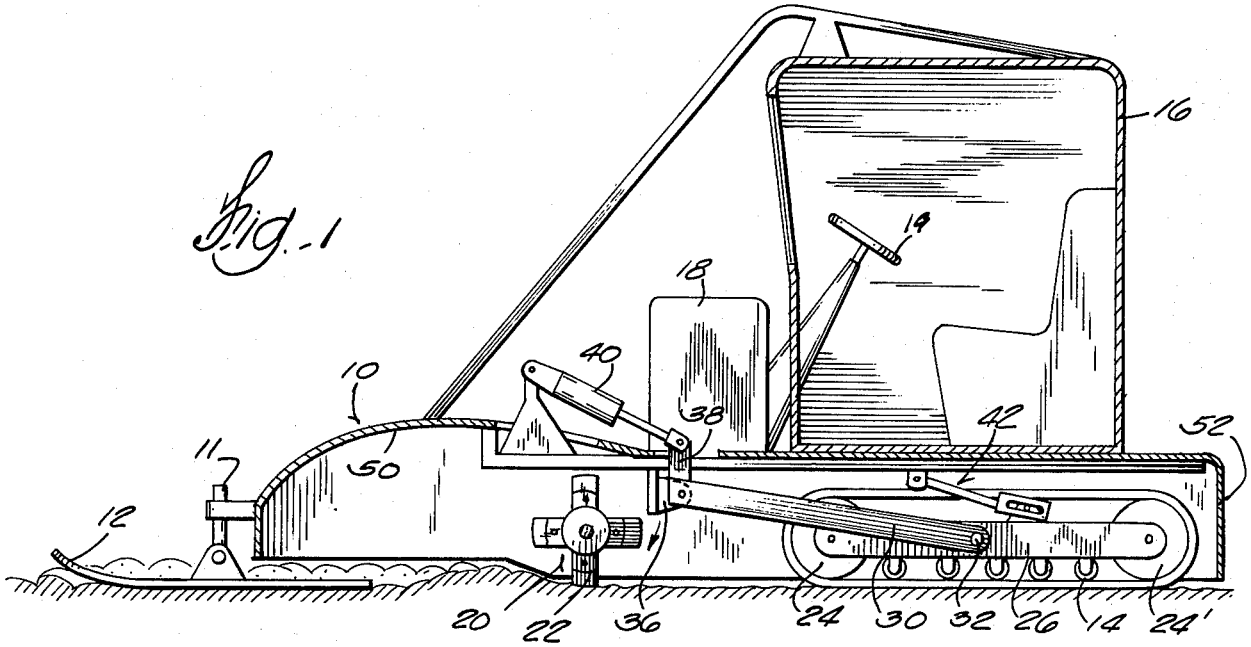
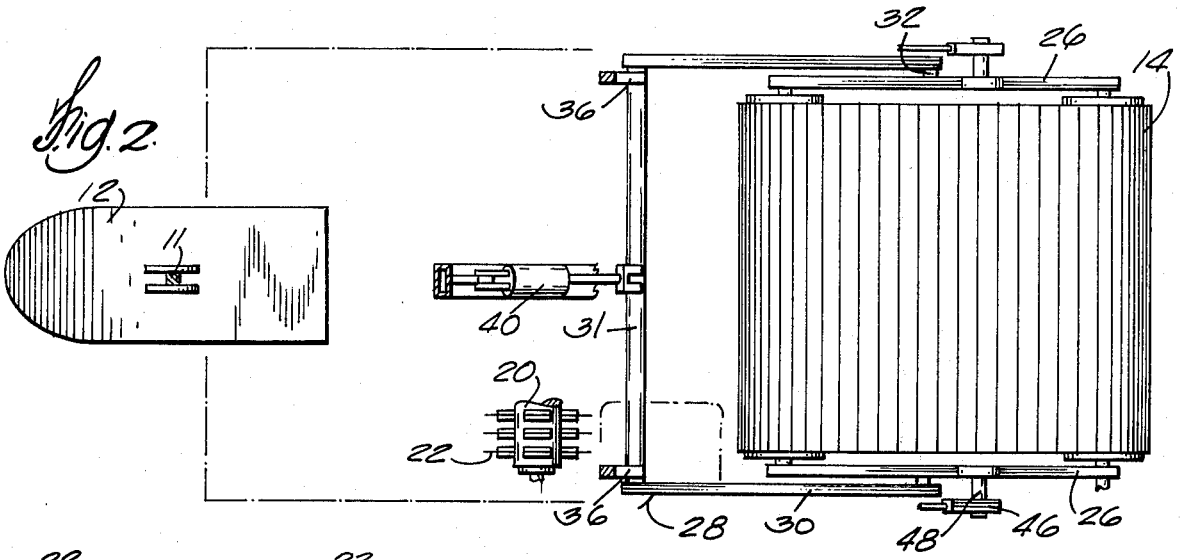
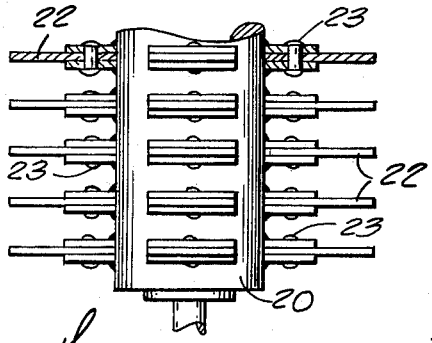
Fig. 3
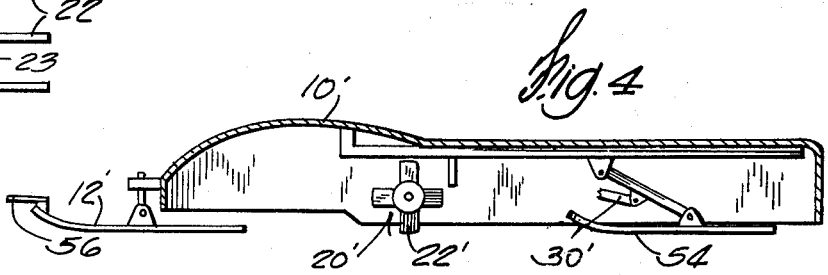
Fig. 4

SNOWMOBILE TRAIL LEVELER

BACKGROUND OF THE INVENTION

The field of the invention pertains to trail levelers which are used for leveling and smoothing trails used by snowmobiles, with the purpose of the trail leveler being to level the "washboard" pattern of hills and valleys which develop on a snowmobile trail after repeated traffic thereon.

Prior to the present invention, the commercially available trail levelers have been of the drag type, using a smooth or toothed blade which is pulled over the trail. Such trail levelers have not been fully satisfactory, principally because in instances where the bite of the blade is set to completely remove the raised portions of the track the power required to pull the blade often exceeds that which is available from the snowmobile by which the drag type leveler has usually been pulled.

SUMMARY OF THE INVENTION

The trail leveling equipment embodying the present invention can either be self-propelled or designed to be towed by a snowmobile or similar equipment. The trail leveler includes a rotating member having a plurality of blades with the rotating member being enclosed at the top and sides by a housing and being rotated by an appropriate power source in a direction opposite to the travel of the leveler. This direction of rotation permits the blades to hit the bumps or raises of the trail at a low point to thereby blast or force the excess material upwardly into the air. The removed material is contained by the housing and falls to the surface fairly uniformly in fairly small particles.

The rear edge of the housing then travels over the worked surface and if a substantial amount of snow has been removed it smooths any unevenness in the particles which cover the worked trail. An adjustment linkage is provided to adjust the vertical position of the leveler and to thus adjust the position of the blades in respect to the trail.

The milling or thrashing of the removed snow by the blades of the leveler embodying the present invention creates a condition which causes the removed snow to freeze shortly after the leveler has passed, and this feature provides for a track which will bear traffic for a much longer time than would a surface which has been leveled by the drag type levelers which have been used heretofore.

DESCRIPTION OF THE DRAWINGS

FIG. 1 is a cross-sectional side view of the trail leveler embodying the present invention;

FIG. 2 is a partially schematic top view of the trail leveler shown in FIG. 1 with portions being broken away for the sake of illustration;

FIG. 3 is a partial top view of the rotating member with two of the blades being shown in cross section; and FIG. 4 is a partially schematic side cross-sectional view of an alternate embodiment of the present invention.

DESCRIPTION OF THE PREFERRED EMBODIMENT

The trail leveler machine shown in FIGS. 1, 2 and 3 is designed to be self-propelled and includes a housing 10, a front ski 12, a cleated track 14, and a suitable cab 16 and engine 18 which are mounted on the housing.

The front ski can be partially rotated in the horizontal plane and is connected to the steering wheel 19 by a suitable linkage (not shown).

A rotating member 20 containing a plurality of spaced blades 22 extends transversely to the intended path of the leveler and is mounted by suitable bearings which are provided in the sidewalls of the housing. The member 20 is connected to the engine 18 by suitable hydraulic or mechanical means and is designed to rotate in a direction opposite to the travel of the leveler, i.e. in a clockwise direction when viewed in FIG. 1. Since the method of transmitting power, either by hydraulic or mechanical means, from the engine to the member 20 can be any one of several well-known methods, and since the specific method of the power transmission forms no part of the present invention, the specific means are not shown.

The cleated track 14 is mounted on driving and supporting wheels 24 and 24' in a known manner, with the drive wheel being connected to the engine by suitable hydraulic or mechanical means (not shown) and with the trail leveler being provided with suitable controls to facilitate control of the power which is delivered to the drive wheel of the track.

The track 14 and its drive wheels are carried by an inner frame 26 which is connected to the housing 10 via an adjustment linkage which permits vertical adjustment of the inner frame with respect to the housing and thus permits adjustment of the height of the rotating member 20 in respect to the surface of the track to be leveled.

The adjustment linkage includes a yoke shaped lever 28 having two fore and aft extending lever arms 30 which are rigidly connected to a transversely extending cross member 31 and are positioned adjacent to each inside sidewalls of the housing 10. The end of each lever arm is connected to the inner frame 26 via a pivotal connection 32 and the cross member is pivotally mounted in flanges 36 located at each side of the housing 10. A crank arm 38 is fixed to the cross member 34 and it is connected to a hydraulic cylinder 40 or other suitable adjustment mechanisms by means of which the yoke shaped lever 28 may be pivoted around its connection to flanges 36 to thus adjust the vertical position of the track in respect to the housing. Since the position of rotating member 20 in respect to the housing is fixed, the adjustment of the position of the track adjusts the position of the rotating member in respect to the trail.

The amount of vertical adjustment of the track is limited by a pin and slot connection 42 provided at each side of the track with each of the connections including a lever 46 having a slotted end, with the slot capturing a pin 48 which is provided on the inner frame 26 as shown in FIGS. 1 and 2.

The blades 22 of the rotating member 20 are spaced in the vertical plane at 90° to each other and each set of blades is spaced equidistantly from the next, as shown in FIGS. 2 and 3. Alternatively, the blades may also be placed in a spiral pattern around the member 22. The blades are fixed to the member 20 and during rotation of the member shave the hills or raised portions of the unleveled trail by hitting such portions at their bottom and throwing the removed material upwardly and towards the shield portion 50 of the housing. Because of the even spacing of the blades the shaved ice or compacted snow chips tend to fall back on the trail surface in a fairly even pattern, however, any unevenness is in any event leveled by the trailing edge 52 of the housing.

The blades 22 are fixed to flanges of member 20 by a pin 23 as shown in FIG. 3. Thus, during rotation of member 20, the blades extend axially in respect to member 20; however, upon hitting an obstruction or a hard object they are pivoted around pin 23 and thus avoid damage to the equipment.

The alternate embodiment shown in FIG. 4 is designed to be pulled by a snowmobile. It is identical in function and operation as that heretofore described except that the cleated track 14 has been deleted and a ski 54 has been provided at the ends of each lever arm 30' of the adjustment linkage. The cab and steering mechanisms have, of course, also been deleted and a tongue 56 has been provided on the front ski to permit towing of the leveler.

I claim:

1. A trail leveler for smoothing the washboard type pattern of snowmobile trails, the leveler being adapted to move over the trail and comprising:

a housing and means to support said housing on the snow as the leveler is moved over the trail to be worked by the leveler;

a rotating member carried by said housing and extending generally transversely to the intended path of the leveler, said rotating member having a plurality of axially extending blades which, upon rotation of said member, are adapted to hit the high sections of the snowmobile trail and to thereby remove such high portions upon impact with the blades and to throw the removed high portions upwardly and towards the inside of said housing; and motor means adapted to rotate said member in a direction opposite to the intended path of the leveler to thereby cause said blades to bite into the bottom sections of the high portions of the trail as the leveler is moved over the trail;

said housing being further characterized by a shield portion on the top inside surface thereof with depending side walls for substantially enclosing the space in which the removed high portions are thrown upwardly, and a depending trailing edge portion thereon to distribute the removed high portions evenly over the trail;

adjustment means for changing the vertical position of said rotatable member with respect to said means to support said housing to thereby adjust the vertical position of said blades with respect to the surface of the trail to be leveled;

said means to support said housing being further characterized by a first means positioned at the front end of said housing and of a second support means positioned generally towards the rear of said housing, and wherein said adjustment means is connected between said housing and one of said support means and is operable to change the vertical distance between said housing and said one of said support means;

said adjustment means further characterized by being connected between said housing and said second support means, and wherein said adjustment means includes lever means which is pivotally connected at one of its ends to said housing and is pivotally connected to the other of its ends to said second support means, and wherein said adjustment means also includes motor means for pivoting said lever means around its connection to said housing, said lever means comprised of a yoke shaped member with the cross member of the yoke being pivotally attached to said housing and with the lever arms of the yoke extending in a generally fore and aft direction adjacent the sides of said housing and being pivotally connected at their ends to said second support means, said lever means further including a crank section which is fixed to said cross member and which is connected to said lever motor means, said lever motor means adapted to rotate said yoke shaped member around the axis of said cross member; and said adjustment means further characterized by having a stop means for limiting the degree of movement of said second support means with respect to said housing.

2. A trail leveler according to claim 1 wherein said extending blades are generally flat with their planes lying in the plane perpendicular to the path of travel of the trail leveler.

3. A trail leveler according to claim 2 wherein said blades are pivotally fixed to said rotating member.

4. A trail leveler according to claim 3 wherein said plurality of blades are distributed substantially evenly around the periphery and along the axis of said rotatable member.

* * * * *